United States Patent [19]

Castillo et al.

[11] 4,241,651

[45] Dec. 30, 1980

[54] ASSEMBLY MACHINE AND METHOD FOR EMBEDDING CONNECTOR PLATES IN STRUCTURAL MEMBERS

[75] Inventors: Adolfo Castillo; Ben Kushner; Andrew G. Seipos, all of Miami, Fla.

[73] Assignee: Automated Building Components, Inc., Miami, Fla.

[21] Appl. No.: 37,458

[22] Filed: May 9, 1979

[51] Int. Cl.[3] ..... B30B 1/32; B30B 15/00

[52] U.S. Cl. ..... 100/35; 100/DIG. 13; 100/100; 100/231; 100/269 R; 227/152

[58] Field of Search ..... 100/DIG. 13, 35, 100, 100/231, 269 R; 227/152; 269/321 F

[56] References Cited

U.S. PATENT DOCUMENTS

| | | | |
|---|---|---|---|
| 3,100,301 | 8/1963 | Black | 100/DIG. 13 |
| 3,315,595 | 4/1967 | Moehlenpah | 100/DIG. 13 |
| 3,460,465 | 8/1969 | McGlinchey | 227/152 X |
| 3,530,790 | 9/1970 | Post | 100/100 |
| 3,599,562 | 8/1971 | Hutchens | 100/100 |
| 3,728,958 | 4/1973 | Moehlenpah | 100/100 |

*Primary Examiner*—Billy J. Wilhite

*Attorney, Agent, or Firm*—LeBlanc, Nolan, Shur & Nies

[57] ABSTRACT

An assembly machine for embedding connector plates in wooden structural members includes a plurality of work stations which can be adjustably positioned along a support frame. Each work station includes a table having a work support surface and an upright C-shaped frame member balanced on a pneumatically operated cylinder and movable upward relative to the table. The frame member supports a lower platen at a rest position slightly below the work support surface and an upper platen movable downward toward the lower platen by a hydraulic power cylinder. Upon actuation of the hydraulic power cylinder, the upper platen is pressed downward into engagement with an upper connector plate on top of the wooden structural members and the lower platen is raised relative to the work table to press a lower connector plate upward against the wooden members. The upper and lower platens apply uniformly distributed forces to the connector plates which are firmly embedded in opposite sides of the wooden members.

30 Claims, 10 Drawing Figures

ASSEMBLY MACHINE AND METHOD FOR EMBEDDING CONNECTOR PLATES IN STRUCTURAL MEMBERS

BACKGROUND OF THE INVENTION

The present invention relates to an apparatus and method for embedding connector plates in wooden structural members and, more particularly, to an assembly machine having a plurality of work stations at which connector plates are pressed into opposite sides of wooden structural elements. Specifically, this invention relates to an assembly machine and method for embedding connector plates in the joints of wooden frame structures such as furniture frames and roof trusses.

Prefabricated wooden frames have been developed in the prior art to facilitate the rapid and convenient assembly of furniture frames and roof trusses. Such frames usually include a plurality of wooden framing members with the joints of the frames fastened together by connector plates. Typically, each connector plate is provided with a relatively large number of elongated nail-like teeth struck therefrom which are embedded in adjacent framing members at the joints of the frame. See, for example, plates of the type disclosed in U.S. Pat. No. 2,877,520 assigned to the same assignee of the present invention.

Various machines have been developed in the prior art for pressing connector plates into wooden members. See, for example, U.S. Pat. No. 3,419,205, assigned to the common assignee herewith, which discloses an apparatus for reinforcing lumber elements, such as railroad ties, by embedding connector plates at the ends of the lumber elements. The machine includes a horizontal clamp pressure platen and a vertical clamp pressure platen for pressing connector plates into the horizontal and vertical surfaces at the end of a lumber element which is rectangular in cross section. In addition, U.S. Pat. No. 3,805,694, assigned to the common assignee herewith, discloses a fluid actuated press for embedding connector plates into the joints of wooden trusses which includes a base including a lower press platen and a floating head including an upper press platen operable by a fluid actuated cylinder carried by the head for moving the head toward and away from the base. The press includes a mechanical linkage coupled to the fluid actuated cylinder to enhance the mechanical advantage at the press platens. Other patents showing similar types of machines are U.S. Pat. Nos. 3,602,237, 3,603,244 and 3,910,512, all of which are assigned to the same assignee as the present application.

Depending on the type of connector plates and wooden members employed in the frame, the assembly machines may be required to produce extremely large forces to embed the teeth of the connector plates into the wooden elements. The amount of force is primarily determined by the wood density, tooth size, and number of teeth per joint. For example, in the case of large trusses, forces up to 80 to 100 tons may be required to embed the connector plates into the wooden structural elements.

A major concern in the application of such large forces to the connector plates is uniform force distribution to avoid distortion of the plates and ensure complete insertion of the nail-like teeth into the wooden members. These requirements are critical to produce strong and permanent frame joints. To achieve the desired uniform force distribution, it is necessary for the press platens to maintain essentially uniform contact with the connector plates and wooden structural elements while the force is applied. The requirement is extremely important in the case where a pair of connector plates is driven simultaneously into opposite sides of the wooden structural elements.

SUMMARY OF THE INVENTION

The present invention provides an apparatus and method for pressing connector plates into wooden structural members which achieves more uniform force distribution over the connector plates and wooden structural members in comparison with prior art devices and provides an improved assembly machine which is extremely effective in applying connector plates simultaneously to both sides of a joint of a furniture frame or truss assembly. This objective is achieved in the present invention by utilizing a floating lower platen normally located at a rest position below the surface of a work table supporting the wooden structural elements and an upper platen which is movable downward by a fluid actuated power cylinder toward the lower platen. The upper platen, lower platen and fluid actuated power cylinder are mounted on a common support frame which is movable relative to the work table and balanced on another fluid actuated cylinder. Upon actuation of the power cylinder, the upper platen is pressed downward into engagement with an upper connector plate on top of the wooden structural elements and the lower platen is raised to press a lower connector plate upward against the wooden elements to embed the plates in the wooden elements. The invention effectively employs movable upper and lower platens which advantageously allow uniformly distributed forces to be applied to connector plates on both surfaces of the frame or truss joint. In addition, the invention contemplates assembly machines with a plurality of adjustable work tables which can be spaced apart at different distances to facilitate the assembly of wooden frames and trusses of various sizes.

In accordance with the invention, an apparatus for embedding connector plates in wooden structural members comprises a table having a work support surface, a lower platen normally located below the work support surface and movable upward relative to the surface, an upper platen mounted above the table and movable downward toward the lower platen, and power means for moving the upper platen downward and raising the lower platen upward relative to the work support surface to press the connector plates into opposite sides of the wooden members. Preferably, the apparatus includes a movable frame member for supporting the upper and lower platens for movement relative to the work support surface and a first fluid operated cylinder mounted on the table for balancing the frame member. The power means comprises a second fluid operated cylinder mounted on the frame member for moving the upper platen downward and raising the lower platen to apply pressure to connector plates on upper and lower sides of the wooden members. The table includes a central opening in the work support surface surrounding the lower platen to allow movement of the lower platen and support frame relative to the work support surface.

A preferred embodiment of the apparatus includes an upright C-shaped frame member having an upper arm extending above the work support surface and a lower arm extending below the work support surface. The lower platen is mounted on the lower arm of the frame member which is engageable with the first fluid operated balancing cylinder, e.g., a pneumatic cylinder. The second fluid operated power cylinder, e.g., a hydraulic cylinder, is mounted on the upper arm of the frame member to support the upper platen above the lower platen. The C-shaped frame member, platens, and power cylinder are effectively balanced on the first fluid operated cylinder to provide a floating frame assembly which allows more uniform force distribution over the connector plates and wooden structural members when the platens are pressed together.

In addition, the preferred emboidment includes one or more fluid operated clamping cylinders located adjacent to the fluid operated power cylinder for clamping the wooden members against the work support surface. Preferably, the clamping cylinders are disposed at opposite sides of the fluid operated power cylinder. Guide means may be provided on the frame member for guiding the movement of the upper platen toward the lower platen. Preferably, the balancing cylinder and clamping cylinders are pneumatically operated, while the power cylinder is hydraulically operated.

The invention is also embodied in an apparatus having a plurality of work stations mounted on a support frame for relative movement to each other to allow the spacing between the stations to be adjusted. Each work station includes a table having a work support surface, a movable or floating frame member extending upward above the table and provided with a first platen thereon normally located below the work support surface, a first fluid operated cylinder for balancing the frame member on the table, and a second fluid operated cylinder mounted on the frame member above the first platen having a second platen mounted thereon for movement downward toward the first platen upon actuation of the second cylinder. The apparatus includes means for actuating the first and second fluid operated cylinders of each station to press the first and second platens into engagement with connector plates on opposite sides of the wooden members and raise the first platen relative to the work support surface to embed the connector plates in the wooden members.

A preferred embodiment of the apparatus includes a device for adjusting the relative positions of the work stations along the support frame. Preferably, the position adjusting device includes an elongated screw member extending longitudinally along the support frame and threadably connected to at least one of the work stations provided with manually operable means, e.g., a hand crank, for rotating the elongated screw member to adjust the position of the work station along the support frame. The work stations are releasably connected by a releasable split nut to the screw member for enabling them to be variably adjusted. Alternatively, the position adjusting device includes an endless chain mounted on a set of pulleys or sprockets on the support frame and coupled to at least one of the work stations. A hand crank may be provided for rotating the pulleys or sprockets to advance the chain and adjust the spacing of the work stations along the support frame. Preferably, a releasable coupler may be provided for selectively coupling each of the work stations to the endless chain. While only two adjustable work stations have been shown and described, any number of work stations can be made to be adjustable, e.g. five such stations. Irrespective of the number of stations that are adjustable the basic operation remains the same.

The invention is further embodied in a method of embedding connector plates in wooden structural members which method includes supporting the wooden structural members on a work support surface, placing a first connector plate on a lower platen normally located below the work support surface and movable upward relative to the support surface, placing a second connector plate on top of the wooden members for engagement by an upper platen movable downward into engagement with the second connector plate and raising the lower platen upward relative to the work support surface to press the first and second connector plates into opposite sides of the wooden members. The pressure applied by the upper and lower platens is uniformly distributed over the first and second connector plates. The method also includes clamping the wooden members on the work support surface while the connector plates are embedded therein.

OBJECTIVES OF THE INVENTION

It is a primary object of the present invention to provide an improved apparatus and method for embedding connector plates in wooden structural members in the assembly of wooden frames and trusses and furniture.

Another object of the invention is to provide an apparatus and method which achieve more uniform force distribution to allow the connector plates to be completely and permanently embedded in the wooden structural members.

It is also an object of the invention to provide an apparatus and method utilizing upper and lower movable platens to uniformly distribute the forces over the connector plates to be embedded on opposite sides of the wooden structural members.

A further object of the invention is to provide an apparatus for embedding connector plates in wooden structural members wherein the upper and lower platens are mounted on a floating C-shaped frame member which allows the lower platen to be raised upward while the upper platen is pressed downward to evenly distribute the forces applied to connector plates at the top and bottom of the wooden structural members.

It is another object of the invention to provide an apparatus for embedding connector plates in wooden structural members wherein the floating C-shaped frame member which supports the upper and lower platens is balanced on a fluid operated cylinder.

It is a further object of the invention to provide an apparatus for embedding connector plates in wooden structural members which includes a plurality of adjustable work tables which are conveniently spaced apart at different distances for convenience in assembly of wooden frames and trusses of different sizes.

These and other objects of the invention will be readily apparent with reference to the drawings.

DESCRIPTION OF THE PREFERRED EMBODIMENTS

Figure 1:
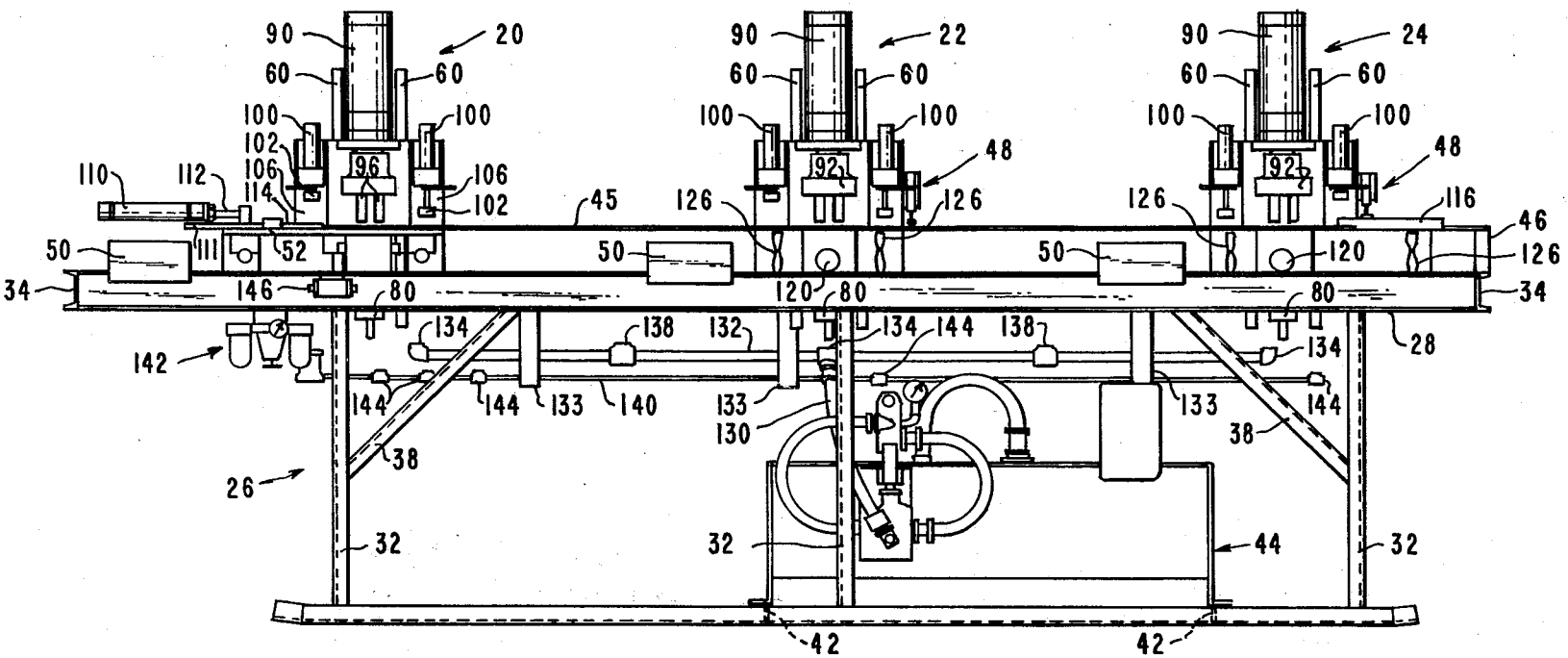
FIG. 1 is a front elevational view of an assembly apparatus including a plurality of work stations embodying the principles of the present invention.
Figure 2:
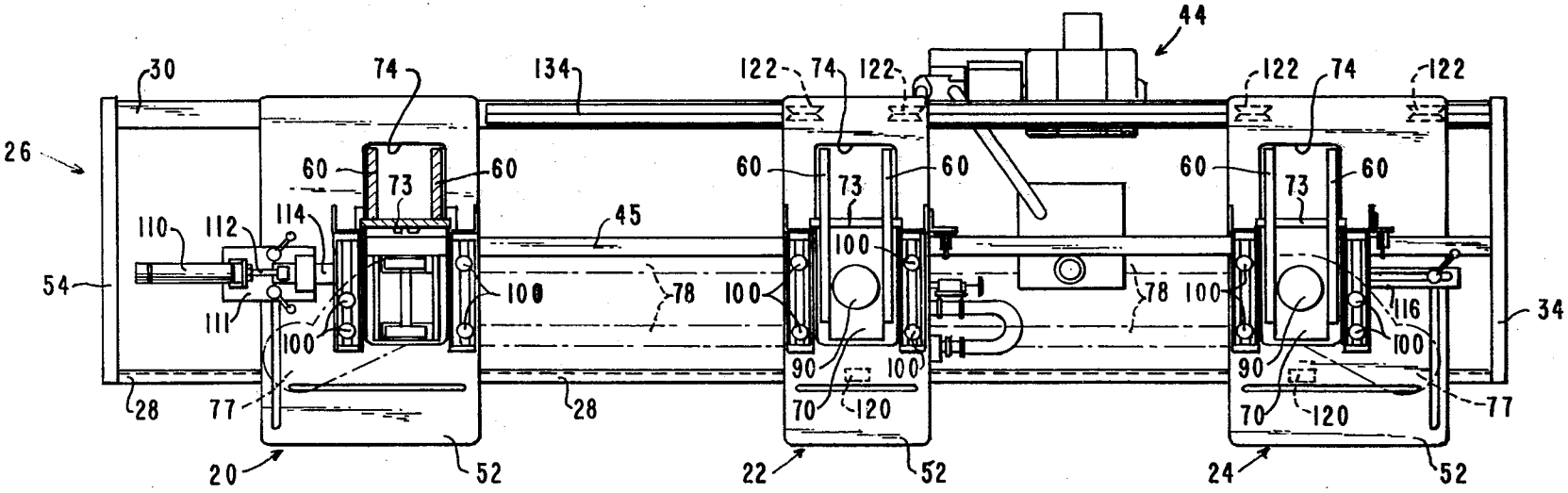
FIG. 2 is a plan view partially in section of the assembly apparatus of FIG. 1.
Figure 4:
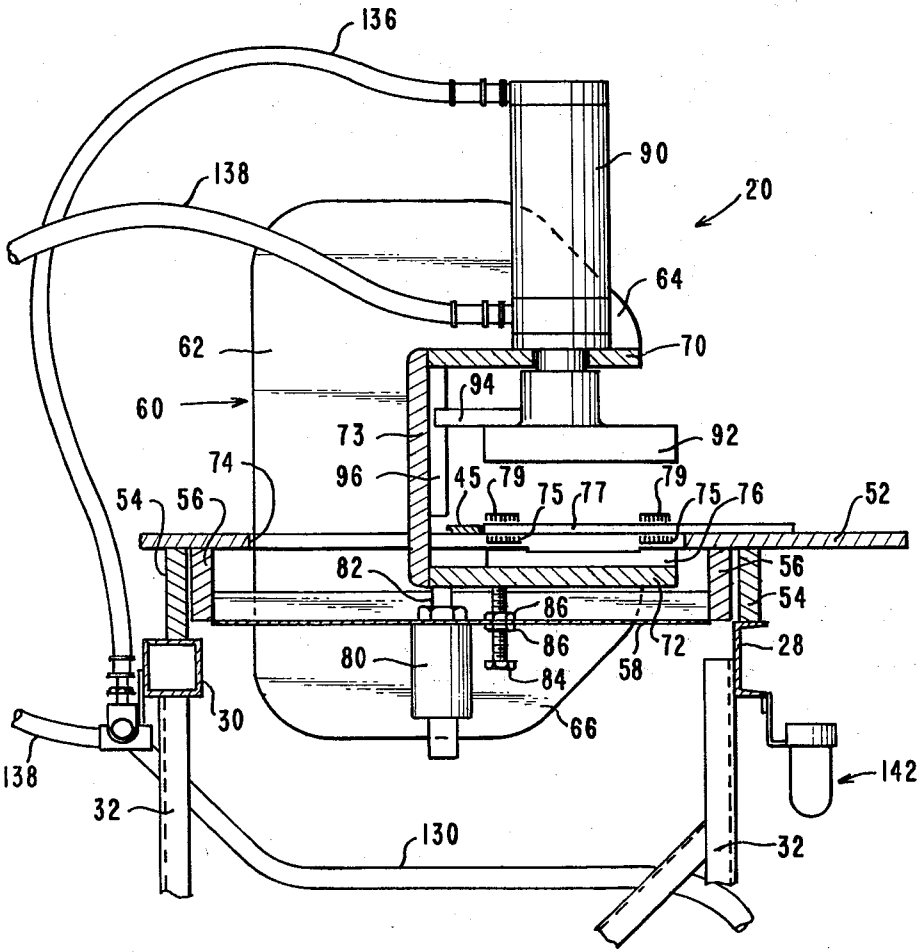
FIG. 4 is a side view, partially in section, of the left-hand work station of FIG. 3.

Referring to FIGS. 1 and 2, an assembly machine for manufacturing wooden frames includes a fixed work station 20 and a pair of movable work stations 22 and 24 mounted on a support frame, generally 26, having a pair of elongated front and back horizontal rails 28 and 30, respectively supported by a plurality of vertical legs 32. The support frame includes a pair of end rails 34 (FIG. 2) secured to opposite ends of elongated rails 28 and 30. Preferably, as shown in FIG. 4, front rail 28 is channel-shaped in cross section and back rail 30 is hollow with a square cross section. The lower ends of legs 32 are secured to a pair of skids 36. A plurality of diagonal struts 38 is provided for reinforcement of the support frame. A horizontal strut 40 (FIG. 5) extends between front and rear legs 32 at the center of the support frame. A pair of horizontal support members 42 (FIG. 1) extends between skids 36 at spaced parallel locations to support a power supply unit 44.

Figure 5:
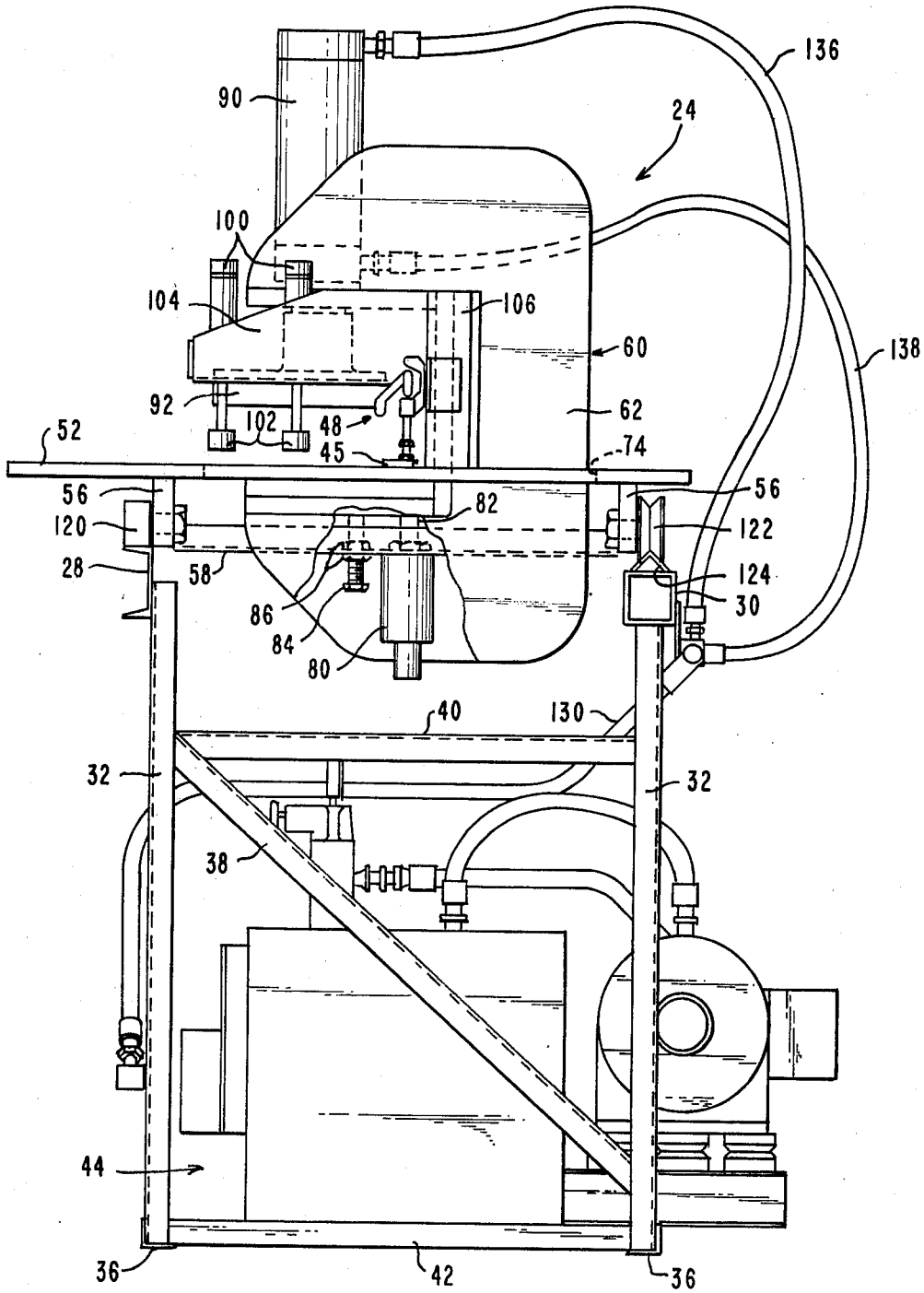
FIG. 5 is an enlarged side view of the right-hand work station of the assembly apparatus of FIG. 1 illustrating a set of clamping cylinders provided at the station.

An elongated position bar 45 (FIGS. 1 and 2) mounted on an upright support member 46 on frame member 34 at the right side of the support frame extends longitudinally between work stations 20, 22 and 24. As shown in FIG. 5, right-hand work station 24 includes a lever-actuated clamping device 48 which is adapted to be clamped on position bar 45 to lock the work station in a desired position along support frame 26. Central work station 22 (FIG. 1) is provided with a similar clamping device 48 to lock the work station in a desired position. Support frame 26 also includes a plurality of storage bins 50 (FIG. 1), each located adjacent to one of the work stations to hold a supply of connector plates.

Figure 3:
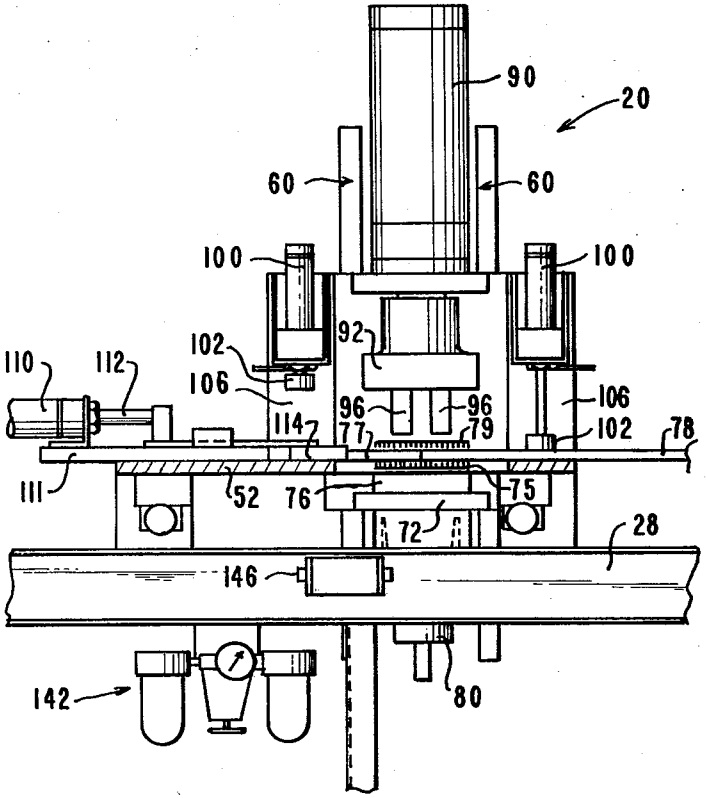
FIG. 3 is an enlarged front view of the left-hand work station of the assembly apparatus of FIG. 1.

As shown in FIGS. 3 and 4, left-hand work station 20 includes a table 52 having flat work support surface mounted in a fixed position by an outer pair of support members 54 secured, e.g., by welding, to front and back rails 28 and 30. An inner pair of support members 56 is welded to the underside of table 52 and spaced inwardly from outer support members 54 to mount a channel-shaped, horizontal support member 58 underneath the work table.

Work station 20 includes an upright frame assembly having a pair of identical C-shaped frame members 60, each having a vertical or upright portion 62, an upper arm 64 extending horizontally above table 52 and a lower arm 66 extending horizontally below the work table. C-shaped frame members 60 are secured together in a spaced parallel relationship by an upper plate member 70 welded to the bottom of upper frame arms 64, a lower plate member 72 welded to the top of lower frame arms 66, and a vertical plate member 73 welded to the front of upright portions 62 of the frame members. C-shaped frame members 60 extend upwardly through an enlarged, rectangular opening 74 (FIG. 2) formed in table 52 which allows the frame assembly to be moved vertically relative to the work table. Plate member 72 supports a lower platen 76 which receives a first pair of connector plates 75 (FIG. 4), each oriented with its teeth pointed upwardly. Normally, platen 76 is located at a rest position below the surface of work table 52 to allow a set of wooden structural elements 77 and 78 (FIGS. 3 and 4) to be placed on the work table without contact with the teeth of connector plates 75. A second pair of connector plates 79 is placed on top of wooden elements 77 and 78, each oriented with its teeth pointed downwardly.

It is important to ensure that connector plates 75 are properly positioned on lower platen 76 each time the machine is actuated. If the plates are not properly positioned on the lower platen, then they will not properly serve to connect the wooden members thereby necessitating the use of other means. In addition, care must be taken to ensure that the plates are positioned so as to clear any pre-drilled holes, future block locations, provide sufficient hardward mounting clearance, and for other similar reasons.

Figure 9:
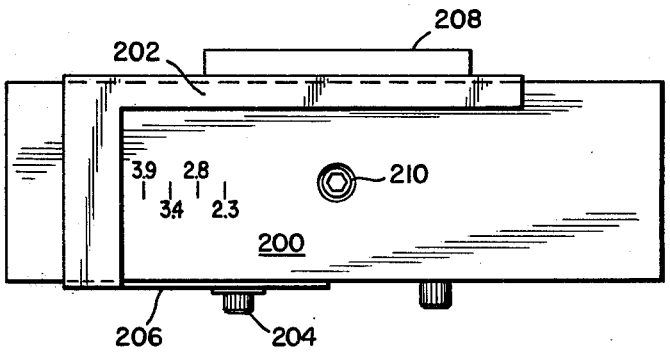
FIG. 9 is a top plan view of a mechanism for adjustably positioning the connector plates.
Figure 10:
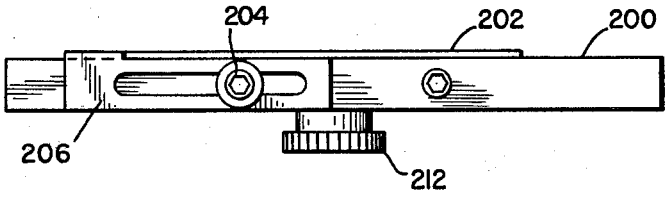
FIG. 10 is a side elevational view of the mechanism shown in FIG. 9.

To assist in the positioning of the connector plates, an adjustable mechanism is provided such as shown in FIGS. 9 and 10. Connector plate 75 is positioned on reaction pad 200 with the flat side down and is nested in the corner of the right angle nest member 202. Nest member 202 is attached to and slidable with bracket 206. By loosening nut 204, bracket 206 and nest member 202 can be slidably positioned. Plate 208 acts both as a guide for the sliding action of nest member 202 and as a nut plate for screw 204. The entire assembly also can be rotated by loosening socket head cap screw 210 and slide nut 212 for changing the angular position of nest member 202 and hence connector plate 75.

The frame assembly includes a first fluid operated balance cylinder 80, preferably a pneumatic cylinder operable by pressurized air, mounted on horizontal support member 58 with an output rod 82 engageable with the underside of lower plate member 72 to move the entire frame assembly upward upon actuation of the cylinder. Preferably, the weight of the entire frame assembly is balanced on output rod 82 of pneumatically operated cylinder 80. An adjustable stop, e.g., a bolt 84 threadedly received by a pair of nuts 86 on opposite sides of support member 58, engages the underside of plate member 72 to allow the rest position of lower platen 76 to be adjusted.

The upright frame assembly includes a second fluid operated power cylinder 90, preferably a hydraulically operated cylinder, mounted on upper plate member 70 and provided with a flat pressure plate or platen 92 coupled to its output rod to engage and press connector plates 79 downward into wooden structural elements 77 and 78 on the work table upon actuation of the cylinder. A guide rod 94 extends rearwardly from upper platen 92 and is received between a pair of vertical guide members 96 mounted on vertical plate member 73 to guide the upper platen in its movement relative to work table 52 and lower platen 76.

Preferably, left-hand work station 20 includes one or more vertical clamping cylinders 100 (FIG. 3), e.g., pneumatically operated cylinders, mounted on work table 52 adjacent to hydraulic power cylinder 90. Clamping elements 102 are coupled to the output rods of the pneumatic cylinders for clamping the wooden structural elements in place on work table 52 while the connector plates are embedded therein. As shown in FIGS. 1 and 2, vertical clamping cylinders 100 may be disposed in pairs on opposite sides of the hydraulic power cylinder. Each pair of clamping cylinders 100 is adjustably mounted on a cantilever arm 104 (FIG. 5) extending from an upright support member 106 secured to table 52. In addition, a horizontal clamping cylinder 110 (FIG. 2) is mounted on an adjustable sliding tray 111 provided on work table 52. Clamping cylinder 110 has an output rod 112 coupled to a clamping member 114 slidably mounted on the work table.

Right-hand work station 24 includes substantially identical components as left-hand work station 20 with the exception that an adjustable stop element 116 is provided on work table 52 of the right-hand station in place of horizontal clamping cylinder 110 of the left-hand station. When clamping cylinder 110 is actuated, slidable clamping member 114 engages and presses wooden structural elements 77 and 78 together against stop element 116 to hold the wooden structural elements in place while the connector plates are embedded therein. Central work station 22 also includes substantially the same components as work stations 20 and 24. However, table 52 of central work station 22 is narrower than the work tables of the left-hand and right-hand work stations because no horizontal clamping devices are included.

Preferably, central work station 22 and right-hand work station 24 are mounted for longitudinal movement along support frame 26 to allow the positions of these stations to be adjusted relative to fixed work station 20. As shown in FIG. 5, right-hand work station 24 includes a roller 120 mounted on its front support member 56 for rolling engagement with front rail 28 of the support frame. In addition, a pair of pulley-like rollers 112 (one shown) is rotatably mounted on rear support member 56 for rolling engagement with an elongated guide member 124 having an inverted V-shaped cross section mounted on back rail 30 of the support frame. Central work station 22 includes a similar roller arrangement to allow its longitudinal movement along the support frame. A pair of handles 126 is provided on central work station 22 and right-hand work station 24 to allow the work stations to be manually moved along the support frame. Alternatively, the assembly apparatus may include a manually operable position adjusting mechanism, described in more detail below, to allow the spacing of the work stations to be adjusted.

Referring to FIG. 1, power supply unit 44 includes a hydraulic output line 130 for supplying fluid under pressure to each of the work stations via a common supply pipe 132. The hydraulic supply pipe is suspended on the support frame by a set of mounting brackets 133 and is provided with separate fluid coupling devices 134 for each station. As shown in FIG. 4, left-hand work station 20 includes a first hydraulic input line 136 to supply pressurized fluid to the cap end of hydraulic cylinder 90 and a second hydraulic input line 138 to supply pressurized fluid to the rod end of the hydraulic cylinder. Similar hydraulic input lines (not shown) are provided at work stations 22 and 24 to supply pressurized fluid to the hydraulic cylinders at these work stations. Supply pipe 132 includes extra coupling devices 138 to allow additional work stations to be coupled to the power supply unit.

In addition, the assembly apparatus includes a pneumatic supply pipe 140 (FIG. 1) coupled via a pressure regulator 142 to a source of pressurized air (not shown). Pneumatic supply pipe 140 is secured to mounting brackets 133 and includes a plurality of taps 144 for supplying pressurized air to balance cylinders 80 of the work stations via suitable connections (not shown) to urge C-shaped frame members 60 and lower platens 75 (FIG. 4) upward. A two-hand control valve 146 is provided for controlling the operation of vertical clamping cylinders 100 and horizontal clamping cylinder 110.

Figure 8:
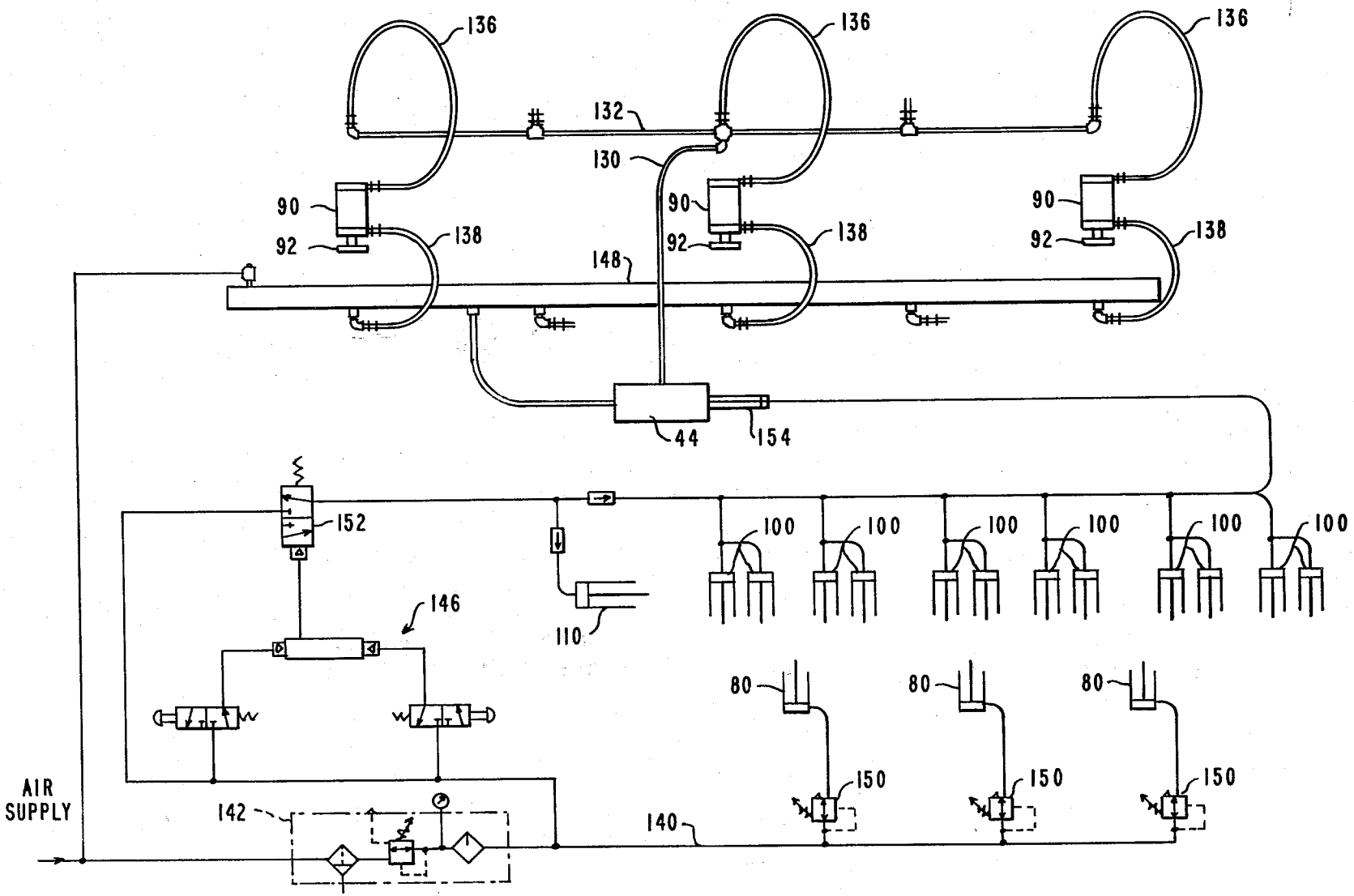
FIG. 8 is a schematic diagram of a pneumatic and hydraulic control system used to operate the work stations of the assembly apparatus.

Referring to FIG. 8, pressurized air is supplied from its source (not shown) to a fluid reservoir 148 which supplies fluid under pressure via input lines 138 to hydraulic cylinders 90 to normally raise platens 92 upward. The pressurized air is also supplied via pressure regulator 142 to pneumatic supply pipe 140 from which it is supplied through a set of pressure regulators 150 to balance cylinders 80. Upon manual actuation of two-hand control valve 146, pressurized air is supplied via a valve 152 to a pneumatic circuit which operates vertical clamping cylinders 100 and horizontal clamping cylinder 110. In addition, the pneumatic circuit actuates a hydraulic control valve 154 which operates power supply unit 44 to supply pressurized fluid to the cap ends of hydraulic power cylinders 90 via input lines 136 to drive upper platens 92 downward. When two-hand control valve 146 is released to deactivate valves 152 and 154, the pressurized fluid supplied from reservoir 148 to the rod ends of the power cylinders returns platens 92 upward and clamping cylinders 100 and 110 are deactivated.

To perform an assembly operation, a pair of connector plates 75 (FIG. 4) is placed on lower platen 76 at each work station. With each lower platen in its rest position, the upwardly pointed teeth on the connector plates are located slightly below the surface of each work table 52. A set of wooden structural members 77 and 78 is placed in abutment on work tables 52 with the joints of the wooden members located over connector plates 75 at each work station. For example, as shown in FIG. 2, a pair of end frame members 77 may be placed on tables 52 at the left-hand and right-hand work stations with elongated frame members 78 extending therebetween. Each elongated frame member 78 may consist of two sections which abut at the central work station. Next, upper connector plates 79 (FIG. 4) are placed on top of the wooden structural members over each joint.

At each work station, the action of balancing cylinder 80 serves to balance the weight of the entire frame assembly, including C-shaped frame member 60, lower platen 76, hydraulic power cylinder 90, and upper platen 92, so that only a relatively small force is required to raise the frame assembly and lower platen upward from the rest position. When the hydraulic power cylinder is actuated to move upper platen 92 downward, the platen is pressed into engagement with connector plate 79 on top of wooden structural elements 77 and 78. When upper platen 92 engages connector plates 79, the downward movement of platen 92 is temporarily halted and the entire frame assembly including lower platen 76 is raised upward to press connector plates 75 into engagement with the bottom of the wooden structural members. Then, under the compressive force applied by the hydraulic cylinder, lower platen 76 and upper platen 92 are pressed together to embed the connector plates into opposite sides of the wooden members. Both platens are, in effect, movable relative to work table 52 to allow uniformly distributed forces to be applied to the connector plates on both surfaces of the frame joint. After the connector plates are firmly embedded in the wooden structural members, hydraulic power cylinder 90 is operated to retract platen 92 upward and to allow lower platen 76 to return to its rest position.

In the operation of the assembly apparatus, the action of balancing cylinders 80 in urging platens 76 upward and the action of hydraulic power cylinders 90 in moving platens 92 downward serves to uniformly distribute the forces over the connector plates to be driven into opposite sides of the wooden structural elements. The balancing action of pneumatic cylinders 80 allows the apparatus to compensate for any misalignment of platen 92 with work table 52 to ensure that the connector plates are completely and permanently embedded in the wooden structural elements.

Figure 6:
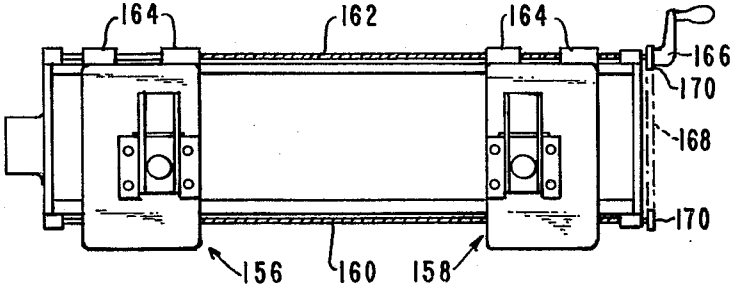
FIG. 6 is a plan view of an embodiment of the assembly apparatus incorporating a screw operated position adjusting mechanism for the work stations.

As shown in FIG. 6, the invention may be embodied in an assembly apparatus including a left-hand work station 156 and a right-hand work station 158 in which one or both of the work stations are adjustable in position on the support frame. A pair of elongated screw members 160 and 162 is rotatably mounted along the front and back of the support frame. Screw members 160 and 162 are threadably connected to one or both work stations via a pair of conventional threaded coupling members 164. A manually operable crank 166 is fixed on rotatable screw member 162 which is coupled via a conventional chain 168 and sprockets 170 for simultaneous rotation with front screw member 160. Upon rotation of hand crank 166, the work stations can be adjusted in position relative to each other.

Figure 7:
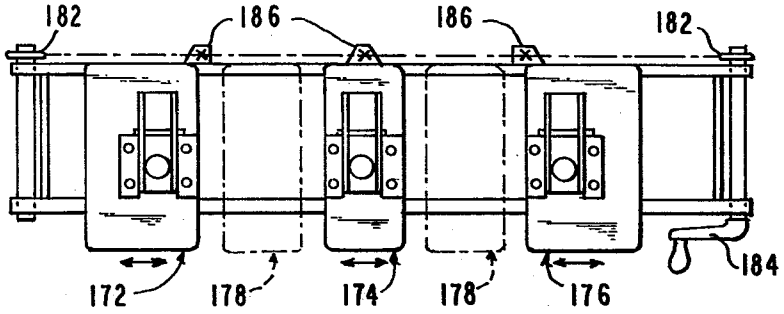
FIG. 7 is a plan view of another embodiment of the assembly apparatus incorporating a pulley and chain or cable mechanism for adjusting the positions of the work stations.

Alternatively, as shown in FIG. 7, the invention may be embodied in an assembly apparatus includng a left-hand work station 172, a central work station 174, and a right-hand work station 176, each of which is movably mounted on the support frame. Additional work stations 178 may be provided, if desired, which are also movable. An endless chain 180 is supported on a pair of sprockets 182 rotatably mounted at opposite ends of the support frame. A hand crank 184 is coupled to one of the sprockets to advance chain 180. Each adjustable work station is provided with a releasable coupling device 186 for selectively coupling the work station to chain 180. Upon rotation of hand crank 184, the relative positions of the work stations can be adjusted along the support frame.

In conclusion, the present invention provides an improved assembly machine for embedding connector plates in wooden structural elements which advantageously allows the large forces required to be uniformly distributed over the connector plates and wooden structural elements to ensure complete and permanent connections at the joints of wood frames and trusses. The provision of a floating frame assembly and a movable lower platen at each work station which is balanced on a pressurized air operated cylinder allows close adjustment of the platen surface to the work support surface of the table to effectively enable the upper and lower platens to simultaneously press connector plates into opposite sides of the wooden structural members upon actuation of the hydraulic power cylinder. In addition, the invention provides an apparatus with a plurality of work stations which are adjustable in position to enhance the flexibility of the apparatus in assembling frames and trusses of different sizes.

While specific embodiments of the invention have been shown and described in detail, it will be understood that the invention may be modified without departing from the spirit of the inventive principles set forth in the appended claims.

We claim:

1. An apparatus for embedding connector plates in structural members, comprising:

a support member having a work support surface;

a lower platen normally located below said work support surface and movable upward relative to said surface;

an upper platen mounted above said work support surface and movable downward toward said lower platen;

first power means for raising said lower platen upward relative to said work support surface to press a connector plate into one side of the structural member; and second power means separate from said first power means, said second power means moving said upper platen downward relative to said work support surface to press a connector plate into the opposite side of the structural members.

2. The apparatus of claim 1, which includes:

a movable frame member for supporting said upper and lower platens for movement relative to said work support surface.

3. The apparatus of claim 2, wherein said first power means includes:

a first fluid operated cylinder mounted on said support member for balancing said frame member and for raising said lower platen upward to apply pressure to the connector plate on the lower side of the structural members.

4. The apparatus of claim 3, wherein said second power means includes:

a second fluid operated cylinder mounted on said frame member for moving said upper platen downward to apply pressure to the connector plate on the upper side of the structural members.

5. The apparatus of claim 4, wherein:

said support member includes a central opening in said work support surface surrounding said lower platen to allow movement of said lower platen and support frame relative to said work support surface.

6. The apparatus of claim 5, wherein said frame member comprises:

an upright C-shaped frame member having an upper arm extending above said work support surface and a lower arm extending below said work support surface; and said lower platen being mounted on said lower arm of said frame member and engageable with said first fluid operated cylinder, and said second fluid operated cylinder being mounted on said upper arm of said frame member to support said upper platen above said lower platen.

7. The apparatus of claim 6, wherein said first cylinder is pneumatically operated and said second cylinder is hydraulically operated.

8. An apparatus for embedding connector plates in structural members, including:

a work support member having a work support surface;

a movable frame member extending upward above said support member and having a first platen thereon normally located below said work support surface;

a first fluid operated cylinder for balancing said frame member on said support member;

a second fluid operated cylinder mounted on said frame member above said first platen and having a second platen mounted thereon and movable downward toward said first platen upon actuation of said second cylinder; and means for actuating said first and second fluid operated cylinders to press said first and second platens, respectively, relative to said work support surface and into engagement with connector plates on opposite sides of the structural members so as to embed the connector plates in the structural members.

9. The apparatus of claim 8, wherein:

said frame member is C-shaped in configuration and includes an upper arm extending above said work support surface and a lower arm extending below said work support surface; and said first platen is mounted on said lower arm of said frame member and engageable with said first fluid operated cylinder, and said second fluid operated cylinder is mounted on said upper arm of said frame member to support said second platen above said first platen.

10. The apparatus of claim 8, further comprising:

one or more fluid operated clamping cylinders located adjacent to said second fluid operated cylinder for clamping the wooden members against said work support surface.

11. The apparatus of claim 10, wherein said clamping cylinders are disposed at opposite sides of said second fluid operated cylinder.

12. The apparatus of claim 8, further comprising:

guide means mounted on said frame member for guiding the movement of said second platen toward said first platen.

13. The apparatus of claim 8, wherein:

said support member includes an enlarged opening formed in its work support surface surrounding said first plate to allow movement of said first platen and said frame member relative to said work support surface.

14. The apparatus of claim 8, wherein said first cylinder is pneumatically operated and said second cylinder is hydraulically operated.

15. An apparatus for embedding connector plates in structural members, including:

a support frame;

a plurality of work stations mounted on said support frame for movement relative to each other to allow the spacing between said stations to be adjusted;

each of said work stations including a support member having a work support surface, a movable frame member extending upward above said support member and provided with a first platen thereon normally located below said work support surface, a first fluid operated cylinder for balancing said frame member on said table, and a second fluid operated cylinder mounted on said frame member above said first platen and having a second platen mounted thereon and movable downward toward said first platen upon actuation of said second cylinder;

means for actuating said first and second fluid operated cylinders of each said support member to press the respective platens into engagement with connector plates on opposite sides of the structural members and raise said first platen relative to said work support surface to embed the connector plates in the structural members.

16. The apparatus of claim 15, which includes:

means for adjusting the relative positions of said work stations along said support frame.

17. The apparatus of claim 15, wherein:

each frame member is C-shaped in configuration and includes an upper arm extending above said work support surface and a lower arm extending below said surface; and said first platen is mounted on said lower arm of said frame member and engageable with said first fluid operated cylinder, and said second fluid operated cylinder is mounted on said upper arm of said frame member to support said second platen above said first platen.

18. The apparatus of claim 15, wherein:

each support member includes an enlarged opening formed in its work support surface surrounding said first platen to allow movement of said first platen and said frame member relative to said work support surface.

19. The apparatus of claim 15, wherein each work station includes:

one or more fluid operated clamping cylinders located adjacent to said second fluid operated cylinder to clamp the structural members on said work support surface.

20. The apparatus of claim 19, wherein said clamping cylinders are disposed at opposite sides of said second fluid operated cylinder.

21. The apparatus of claim 15, further comprising:

guide means on each frame member for guiding said second platen in its movement relative to said first platen.

22. The apparatus of claim 15, wherein said first cylinder is pneumatically operated and second cylinder is hydraulically operated.

23. The apparatus of claim 16, wherein said position adjusting means comprises:

an elongated screw member extending longitudinally along said support frame and threadably connected to at least one of said work stations; and manually operable means for rotating said elongated screw member to adjust the position of said one work station along said support frame.

24. The apparatus of claim 23, which includes:

coupling means for coupling each of said work stations to said elongated screw member so that the relative position of each work station can be variably adjusted.

25. The apparatus of claim 16, wherein said position adjusting means comprises:

an endless chain mounted on a set of sprockets on said support frame, said chain being coupled to at least one of said work stations; and manually operable means for rotating said pulleys to advance said chain and adjust the spacing of said work stations along said support frame.

26. The apparatus of claim 25, which includes:

coupling means for coupling each of said work stations to said endless chain.

27. A method of embedding connector plates in structural members, comprising:

supporting the structural members on a work support surface;

placing a first connector plate on a lower platen normally located below said work support surface and movable upward relative to said surface;

placing a second connector plate on top of the wooden members for engagement by an upper platen movable downward toward said lower platen; and pressing said upper platen downward into engagement with the second connector plate and independently raising said lower platen upward relative to said work support surface to press the first and second connector plates into opposite sides of the structural members.

28. The method of claim 27, wherein the pressure applied by said upper and lower platens is uniformly distributed over the first and second connector plates.

29. The method of claim 27, which includes:

clamping the structural members on said work support surface while the connector plates are embedded therein.

30. The apparatus according to claim 1, 8 or 15, further comprising guide means for positioning a connector plate, that is to be embedded in a structural member, on said platen below said work support surface, said guide means being adjustable and capable of holding such connector plate in place during a pressing operation.

* * * * *